US007803200B2

(12) United States Patent
Oh

(10) Patent No.: US 7,803,200 B2
(45) Date of Patent: Sep. 28, 2010

(54) FUEL ADDITIVE COMPOSITION

(76) Inventor: Mi-Hye Oh, 105-606 Busongwoonam apt., 216-2 Busong-dong, Jeollabuk-do, Iksan-city (KR) 570-972

( * ) Notice: Subject to any disclaimer, the term of this patent is extended or adjusted under 35 U.S.C. 154(b) by 443 days.

(21) Appl. No.: 11/850,240

(22) Filed: Sep. 5, 2007

(65) Prior Publication Data

US 2009/0056202 A1 Mar. 5, 2009

(51) Int. Cl.
*C10L 1/12* (2006.01)
*C10L 10/02* (2006.01)
*C10L 9/00* (2006.01)

(52) U.S. Cl. ..... 44/322; 44/280; 44/314; 44/320; 44/434; 44/451; 44/457

(58) Field of Classification Search ..... 44/320, 44/322

See application file for complete search history.

(56) References Cited

U.S. PATENT DOCUMENTS 4,174,953 A * 11/1979 Sun et al. ..... 44/624

FOREIGN PATENT DOCUMENTS

WO WO 2004104141 A2 * 12/2004

* cited by examiner

*Primary Examiner*—Ellen M McAvoy
*Assistant Examiner*—Pamela Weiss
(74) *Attorney, Agent, or Firm*—Lexyoume IP Group, PLLC.

(57) ABSTRACT

The present invention provides a fuel additive composition, and more particularly, to the fuel additive composition comprising hydrogen peroxide, silicate, borax, sodium hydroxide or potassium hydroxide, and water.

When the fuel additive composition of the present invention is added to fuels such as coal, oil, gas and etc., it stimulates fuel combustion, induces the complete combustion of fuel, and increases the heat transfer by preventing clinker formation and fouling in combustion apparatus. In particular, when the fuel additive composition is added to the coal, it increases a pulverizing efficiency in pre-treatment process, thereby facilitating supply of the coal to combustion apparatus advantageously.

5 Claims, No Drawings

FUEL ADDITIVE COMPOSITION

FIELD OF THE INVENTION

The present invention relates to a fuel additive composition which can be added to fuels such as coal, gas, oil and etc. More specifically, the present invention is to stimulate fuel combustion, to induce the fuel combustion completely, and to prevent clinker formation and fouling in the combustion apparatus. In addition, when the fuel additive composition is added to the coal, it improves the pulverizing efficiency in pretreatment process.

BACKGROUND OF THE INVENTION

In general, a physical method has been used to remove soot and clinker produced in combustion apparatus. To reduce air-polluting material, exhaust gas produced from the combustion apparatus was post-treated.

In addition, a mechanical system was used to improve heat efficiency.

However, the conventional methods have many problems because of the operation condition of the combustion apparatus or fuel properties.

In particular, for combustion apparatus using fossil fuel, transient fuel and biomass, slurries such as solid materials are formed therein resulting in an increased consumption of fuel and decreased combustion efficiency.

SUMMARY OF THE INVENTION

An object of the present invention is to provide a fuel additive composition which can be added to fuels such as coal, oil, gas and etc., and more specifically, the fuel additive composition stimulates fuel combustion, induces the complete combustion of fuel, and increase the heat transfer by preventing clinker formation and fouling in the combustion apparatus. In addition, when the fuel additive composition is added to the coal, it can improve the pulverizing efficiency in pre-treatment process of the coal, thereby facilitating supply of the coal to combustion apparatus.

To achieve the object, the present invention provide a fuel additive composition comprising 100 parts by weight of hydrogen peroxide, 5-120 parts by weight of silicate, 10-140 parts by weight of borax, 10-140 parts by weight of sodium hydroxide or potassium hydroxide and 15-300 parts by weight of water.

In an embodiment of the present invention, the fuel additive composition is added to 100 parts by weight of fuel in an amount of 0.02 to 0.5 parts by weight.

In another embodiment of the present invention, the composition further comprises a water-soluble dispersing agent in an amount of 0.1 to 100 parts by weight based on 100 parts by weight of the composition.

In further embodiment, the present invention provides a use of the fuel additive composition prepared by the present invention.

In further embodiment, the present invention provides method of reducing air-polluting materials comprising combusting a fuel with the addition of a fuel additive composition, and where the fuel additive composition comprises 100 parts by weight of hydrogen peroxide, 5-120 parts by weight of silicate, 10-140 parts by weight of borax, 10-140 parts by weight of sodium hydroxide or potassium hydroxide and 15-300 parts by weight of water. In the method of reducing air-polluting materials, the air-polluting material is at least material selected from the group consisting of $SO_x$, $NO_x$, CO and dust. $SO_x$, $NO_x$, CO or dust is reduced by 30% or more, 25% or more, 50% or more or 55% or more on the basis of the combustion of the fuel without the addition of the fuel additive composition.

In still further embodiment, the present invention provides a method of saving a fuel in a combustion apparatus by using the fuel additive composition of the present invention. On the basis of the combustion of the fuel without the addition of the fuel additive composition, the present method saves a fuel by 55% or more.

In further embodiment, the present invention provides a method of preventing clinker formation and fouling inside combustion apparatus by using the fuel additive composition of the present invention.

DETAILED DESCRIPTION

The present invention will be described in detail.

An embodiment of the present invention is to provide a fuel additive composition which can be added to the fuels such as coal, oil, gas and etc.

The hydrogen peroxide releases an oxygen radical to stimulate combustion of fuel.

Hereinafter, the term "oxygen radical" is referred to atomic oxygen with high reactivity, because it exists in a very short time and unstable chemically.

In the composition of the present invention, the hydrogen peroxide produces oxygen radical, thereby stimulating combustion of fuel flowed to the combustion apparatus, and facilitating fuel combustion in low oxygen atmosphere.

In addition, in combustion apparatus, the composition reduces the amounts of $NO_x$ (thermal $NO_x$), $SO_x$, and CO, and the production of particulate matters such as dust, and microparticle.

Because the hydrogen peroxide produces oxygen radical or oxygen molecule at room temperature, the production of oxygen radical at low temperature is suppressed by using silicate.

As a result, at about 400° C., a large amount of oxygen radicals are produced to stimulate fuel combustion by increasing a contact capacity for oxygen. At about 800° C. or more, oxygen radical of borax stimulates fuel combustion.

The silicate can be at least an alkali silicate selected from the group consisting of $Na_2O.SiO_2$, and $K_2O.SiO_2$, and is preferably water glass.

Moreover, the silicate in the fuel additive composition retards the decomposition of hydrogen peroxide at a heating temperature of about 180° C. as well as room temperature.

The silicate releases a small amount of oxygen radical gradually over about 180° C., and a large amount of oxygen radical over about 400° C., thereby stimulating fuel combustion and quickly combusting the fuel at low oxygen concentration.

In addition, the silicate prevents corrosion of combustion apparatus at a low temperature, increases dispersion of material in an aqueous solution to reduce the difference in specific gravity, and heightens the melting point of ash.

The borax is preferably $Na_2B_4O_7.10H_2O$, and removes soot and clinker in combustion apparatus to increase heat transfer. As a result, it prevents corrosion of surface of combustion apparatus, and increases durability.

When the composition of the present invention is used by mixing with petroleum oil, coal or etc., a part of borax is decomposed to release oxygen radical, and a part of borax which is not decomposed settles down on surface of combustion apparatus and its appurtenance to form film thereon, and then suppress the corrosion of combustion apparatus at high temperature Furthermore, as the borax reducing viscosity of ash, it suppresses the formation and adhesion of particulate materials such as soot, clinker, and sludge. Thus, the borax increases thermal efficiency and reduce the air-polluting materials such as dust, smog, $NO_x$ and $SO_x$.

In other words, the fuel additive composition of the present invention induces reduction of thermal $NO_x$ in combustion apparatus by producing radical oxygen. In addition, Na contained in the composition forms sulphate of soda and is discharged from a lower part, and thus suppresses the release of $SO_x$ in air.

The borax is in form of powder and is easily added by dissolving it in water. However, as it can precipitate with passage of time, the temperature of water is preferably maintained in a range of 50 to 95° C., and are added by sodium hydroxide (or potassium hydroxide) and silicate for increasing the solubility of borax in water.

As described above, the fuel additive composition can be prepared by uniformly dispersing 100 parts by weight of hydrogen peroxide, 5-120 parts by weight of silicate, 10-140 parts by weight borax, 10-140 parts by weight of sodium hydroxide (or potassium hydroxide) and 15-300 parts by weight of water.

If each component is used out of the specific ranges, delayed combustion causes the increased consumption of fuel, deteriorated suppression of clinker and fouling, and the precipitation of water dispersion disadvantageously.

To uniformly disperse the composition in water, a water-soluble dispersing agent can be used, for example, glycerin or triethanolamine.

The amount of the water-soluble dispersing agent can be determined by considering the improvement of dispersing uniformity without affecting the change in characteristics of the composition. Preferably, the dispersing agent is used at an amount of 0.1 to 100 parts by weight on the basis of 100 parts by weight of the composition.

The fuel additive composition of the present invention can be added in a suitable amount to the fuel, depending on the kind and quality of fuel, and operating condition of combustion apparatus. For example, the fuel additive composition is used in an amount of 0.02 to 0.5 parts by weight on the basis of 100 parts by weight of fuel preferably.

The preparation method of fuel additive composition cannot be limited particularly, and can be a general mixing method.

Preferably, borax is added at a temperature of 50° C. to 95° C. to maximize the solubility of the borax in water. By adding hydrogen peroxide in final step of the preparation process, the concentration of produced oxygen radical can be controlled suitably.

If hydrogen peroxide, borax and sodium hydroxide are mixed simultaneously, the excessive production of oxygen radical induces air bubbles and loss of oxygen radical. The order of mixing is not limited thereto.

The composition of the present invention can be added to any kinds of fuels. The examples of fuel are solid fuel, liquid fuel, and gas fuel. For examples, the solid fuel includes coal, coke, charcoal and etc. The examples of liquid fuel include gasoline, paraffin oil, light oil, heavy oil, coal tar, oil sand, oil shale, methanol, ethanol, and etc. The examples of gas fuel include natural gas, liquefied petroleum gas (LPG), hydrogen, acetylene, and etc.

Before the ash of fuel is melt, the fuel additive composition combusts carbon particle (coal etc.), and thus prevents the entanglement of carbon particles and ash, fouling and formation of clinker, soot, and sludge in combustion apparatus by changing the film formation of borax and viscosity of ash.

The clinker formation is suppressed by preventing lowered melting point of ash in a reducing atmosphere of the combustion apparatus.

In addition, when ash is melted through borax bead reaction by heating borax in pore of coal, the borax prevents the adhesion of ash, and remnant borax which is not decomposed is deposited and formed to film on surface of the combustion apparatus and its appurtenance, resulting in suppression of corrosion at high temperature and increasing heat transfer efficiency by suppressing the adhesion of clinker.

Particularly, the fuel additive composition of present invention is dispersed in water to improve the pulverizing degree of microparticulate coal. The composition reduces an amount of ash by stimulating the combustion with oxygen radical, and increases the recycling value of coal ash.

When the composition is combusted with the addition of coal, briquette (nine-hole briquette etc.), coke, charcoal, biomass, or etc., it improves combustion efficiency and reduces smell of smoke and sulfur.

The present invention is further explained in more detail with reference to the following examples. These examples, however, should not be interpreted as limiting the scope of the present invention in any manner.

Example 1

To produce the fuel additive composition, 15 kg of borax and 20 kg of sodium hydroxide were dissolved in 50 kg of water at 70° C., and then were added with 20 kg of silicate (water glass) and 20 kg of hydrogen peroxide.

The produced fuel additive composition did not precipitate borax with passage of time and was stable aqueous solution.

Comparative Example 1

This comparative example 1 was carried out as the substantially same method of Example 1, except that the borax and sodium hydroxide were dissolved at a temperature of 40° C.

The composition produced precipitates on the bottom with passage of time.

Example 2

Pulverizing Efficiency of Coal

The composition of Example 1, water, and coal were mixed at a weight ratio of 1:10:1000 to produce a mixture. The mixture was spayed on lump coal which was gone through from coal feeder, and then the pulverizing efficiency of coal was measured in the coal pulverizer.

The composition and physical properties of the used lump coal, and operating condition of the pulverizer were summarized in Tables 1 and 2. The test results were shown in Table 3.

TABLE 1

The composition and physical properties of the used lump coal

| classification | Content | Classification | content |
|---|---|---|---|
| Carbon | 57.36% | Dried ash | 32.90% |
| Hydrogen | 2.77% | Dried sulfur | 0.37% |
| Oxygen | 4.86% | Dried volatile material | 11.66% |
| Nitrogen | 0.94% | Dried volatile material free of ash | 17.68% |
| Moisture content (wet basis) | 4.20% | Heat (caloric value) | 5260 kcal/kg |

TABLE 1-continued

| The composition and physical properties of the used lump coal | | | |
|---|---|---|---|
| classification | Content | Classification | content |
| Moisture content (dry basis) | 1.17% | Grindability (Hard Groove Index, HGI) | 145 |

TABLE 2

| Operation condition of pulverizer | |
|---|---|
| classification | Value |
| feed speed of lump coal | 100 r/min |
| Output speed | 198 kg/h |
| Air volume | 1475 $m^3$/h |
| Temperature at inlet of pulverizer | 258° C. |
| Temperature inside pulverizer | 358° C. |
| Temperature at oulet of pulverizer | 135° C. |
| Pressure difference between interior and exterior of pulverizer | 1183 Pa |
| Pulverizing speed | 33 r/min |
| Fan speed for drying powder | 8 r/min |

Comparative Example 2

This comparative example 2 was carried out as the substantially same method of Example 2, except that the mixture was not spayed on lump coal. The test results were shown in Table 3.

TABLE 3

| | Example 2 | Comparative Example 2 |
|---|---|---|
| Distribution of particles lager than $R_{90}$ (remnants of 90 mesh, %) | 9.90% | 11.72% |
| Distribution of particles lager than $R_{200}$ (remnants of 200 mesh, %) | 0.66% | 1.12% |
| particle uniformity (filtrates of 100 mesh, %) | 0.971 | 0.962 |

As shown in the Table 3, the fuel additive composition of the present invention (Example 2) shows the decease of distribution of particles lager than $R_{90}$ by 15.53%, and the decease of distribution of particles lager than $R_{200}$ by 41.07%, compared to the composition of Comparative Example 2. As the particle uniformity in the fuel additive composition of the present invention (Example 2) was improved, it would be possible to supply a coal having particle size useful for a large-scaled combustion apparatus.

Example 3

The pulverized coal obtained by Example 2 was combusted at 3.5 of excess air factor, and measured for an extent of producing air-polluting materials, fuel saving effect, and the suppression of clinker and fouling formation.

In the test, burner size ($m^3$)=(width×length×height)=(1.62×1.86×5.22), 200 kg/hr (1,328,600 kcal/hr) of combustion volume per hour, 84,624 kcal/hr·$m^3$ of combustion volume per area, 1,249° C. of temperature inside the burner, 150° C. of temperature of exhaust gas. The test result was summarized in Table 4.

a) An extent of producing air polluting material: The exhaust gas was analyzed to $SO_x$ (precipitate appropriate), $NO_x$ (naphthylethylenediamine photometric method), CO (Nondispersive infrared analysis) and dust concentration (Ringelman turbidity method).

b) Fuel saving effect was measured by using incombustible material content in ash c) Suppression effect of clinker and fouling formation were detected with the naked eye by using a test piece adhered to inside the burner.

Example 4

The pulverized coal obtained by Example 2 was combusted in the substantially same condition of Example 3, except for at 1.3 of excess air factor, and then measured for an extent of producing air-polluting material, fuel saving effect, the suppression of clinker and fouling formation. The test result was summarized in Table 4.

Comparative Example 3

The pulverized coal obtained by Comparative example 2 was combusted in the substantially same condition of Example 3, except for at 3.5 of excess air factor, and then measured for an extent of producing air polluting material, fuel saving, the suppression of clinker and fouling formation. The test result was summarized in Table 4.

Comparative Example 4

The pulverized coal obtained by Comparative example 2 was combusted in the substantially same condition of Example 3, except for at 1.3 of excess air factor, and then measured for an extent of producing air polluting material, fuel saving, the suppression of clinker and fouling formation. The test result was summarized in Table 4.

TABLE 4

| | Example 3 | Comparative Example 3 | Example 4 | Comparative Example 4 |
|---|---|---|---|---|
| SOx (ppm) | 211 | 320 | 173 | 261 |
| NOx (ppm) | 602.6 | 858.7 | 612.8 | 824.6 |
| CO (ppm) | 12.23 | 27.12 | 11.74 | 27.36 |
| Dust (mg/$m^3$) | 5 | 13 | 12 | 35 |
| Incombustible material content in ash (%) | 15.30 | 28.70 | 19.52 | 32.72 |
| Formation of clinker and fouling | X | X | ○ | ○ |

As shown in Table 4, the fuel additive composition of the present invention (Example 3) showed an extent of producing air polluting materials for $SO_x$ (34.06%), $NO_x$ (29.82%), CO (54.90%) and dust (61.54%), 46.69% improvement of fuel saving (i.e., decease of incombustible material in ash), and good suppression of clinker and fouling formation.

As explained in the above, the fuel additive composition of the present invention comprises hydrogen peroxide, silicate, borax, sodium hydroxide (or potassium hydroxide), and water to stimulate fuel, to induce complete combustion, to prevent clinker formation and fouling inside combustion apparatus, thereby increasing the heat transfer. In particular, when the fuel additive composition is added to coal, pulverizing efficiency is increased in pre-treatment process to increase combustion efficiency of fuel, thereby easily supplying the coal useful in large-sized combustion apparatus.

What is claimed is:

1. A method of reducing SOx, NOx, CO and dust comprising combusting a fuel with the addition of a fuel additive composition, where the fuel additive composition comprises 100 parts by weight of hydrogen peroxide, 5-120 parts by weight of silicate, 10-140 parts by weight of borax, 10-140 parts by weight of sodium hydroxide or potassium hydroxide and 15-300 parts by weight of water, and where 30% or more of SOx, 25% or more of NOx, 50% or more of CO, and 55% or more of dust are reduced based on the combustion of the fuel without the addition of the fuel additive composition.

2. The method of reducing air polluting materials SOx, NOx, CO and dust according to claim 1, wherein the silicate is at least an alkali silicate selected from the group consisting of $Na_2O.SiO_2$ and $K_2O.SiO_2$.

3. The method of reducing SOx, NOx, CO and dust according to claim 1, wherein 0.02 to 0.5 parts by weight of the composition is added to 100 parts by weight of a fuel of solid fuel, liquid fuel or gas fuel.

4. The method of reducing SOx, NOx, CO and dust according to claim 1, wherein the composition comprises further at least a water-soluble dispersing agent selected from the group consisting of glycerin and triethanolamine.

5. The method of reducing SOx, NOx, CO and dust according to claim 4, wherein the water-soluble dispersing agent is contained in an amount of 0.1 to 100 parts by weight based on 100 parts by weight of the composition.

* * * * *